US006283020B1

(12) United States Patent
Ohno

(10) Patent No.: US 6,283,020 B1
(45) Date of Patent: Sep. 4, 2001

(54) STENCIL PRINTING APPARATUS

(75) Inventor: Katsumi Ohno, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/543,885

(22) Filed: Apr. 6, 2000

Related U.S. Application Data

(62) Division of application No. 09/271,323, filed on Mar. 18, 1999, now Pat. No. 6,076,458.

(30) Foreign Application Priority Data

Mar. 20, 1998 (JP) ..... 10-072540

(51) Int. Cl.[7] ..... B41L 13/04
(52) U.S. Cl. ..... 101/116; 101/118; 101/119
(58) Field of Search ..... 101/116, 118, 101/119, 120, 128.1, 129, 128.4, 126, 114, 477

(56) References Cited

U.S. PATENT DOCUMENTS 5,323,706 * 6/1994 Sugawara ..... 101/477
5,520,108 * 5/1996 Hasegawa et al. ..... 101/477
5,560,299 * 10/1996 Takahira ..... 101/477
5,575,205 * 11/1996 Iida ..... 101/116
5,673,619 * 10/1997 Ohinata et al. ..... 101/477
5,713,279 * 2/1998 Iida ..... 101/116
5,724,888 * 3/1998 Okuda et al. ..... 101/116
5,782,179 * 7/1998 Kawagawa et al. ..... 101/128.4
5,799,577 * 9/1998 Takahashi ..... 101/114
5,813,329 * 9/1998 Tateishi et al. ..... 101/116
5,816,149 * 10/1998 Kawagawa et al. ..... 101/128.4
5,927,192 * 7/1999 Takahashi ..... 101/128.4
5,964,148 * 10/1999 Ishii ..... 101/116
5,970,869 * 10/1999 Hara et al. ..... 101/128.4
6,098,536 * 8/2000 Ohkawa ..... 101/118
6,186,062 * 2/2001 Ohno ..... 101/118

FOREIGN PATENT DOCUMENTS

0639466 * 2/1995 (EP) .

* cited by examiner

*Primary Examiner*—Eugene Eickholt
(74) *Attorney, Agent, or Firm*—Kanesaka & Takeuchi

(57) ABSTRACT

The stencil printing apparatus of the present invention is provided with a stencil making section for perforating each stencil sheet with a desired image pattern, a porous structure printing drum incorporating an ink supply mechanism and coming to have a stencil sheet perforated in the stencil making section to be wound thereon, a sheet supply section for supplying print sheets, a roller for pinching the print sheet supplied from the sheet supply section between the printing drum and itself, and time counting means for counting the rest time of the stencil printing apparatus. The stencil printing apparatus of the present invention is further provided with controlling means for winding a non-perforated stencil sheet on the printing drum, inhibiting supply of print sheets from the sheet supply section, rotating the printing drum on which the non-perforated stencil sheet is wound, and controlling the pinching time with which the printing drum is pressed against the roller according to the time data counted by the time counting means variably.

1 Claim, 13 Drawing Sheets

FIG. 12 x : REST TIME (h)

| 6≦x<12 | 12≦x<18 | 18≦x<24 | 24≦x<36 | 36≦x<48 | 48≦x<72 |
|---|---|---|---|---|---|
| 6 | 7 | 8 | 9 | 10 | 10 |

FIG. 13 y : TEMPERATURE IN DRUM (℃)

| y≦10 | 10<y≦15 | 15<y≦20 | 20<y≦25 | 25<y≦30 | 30<y |
|---|---|---|---|---|---|
| 9 | 8 | 7 | 6 | 5 | 5 |

FIG. 14 x : REST TIME (h)
y : TEMPERATURE IN DRUM (℃)

| y(℃) \ x(h) | x<12 | 12≦x<18 | 18≦x<24 | 24≦x<36 | 36≦x<48 | 48≦x<72 |
|---|---|---|---|---|---|---|
| y≦10 | 6 | 7 | 8 | 9 | 10 | 10 |
| 10<y≦15 | 5 | 7 | 7 | 8 | 9 | 10 |
| 15<y≦20 | 5 | 5 | 6 | 7 | 8 | 9 |
| 20<y≦25 | 5 | 5 | 5 | 6 | 7 | 8 |
| 25<y≦30 | 5 | 5 | 5 | 5 | 6 | 7 |
| 30<y | 5 | 5 | 5 | 5 | 5 | 6 |

STENCIL PRINTING APPARATUS

This application is a divisional of U.S. Ser. No. 09/271,323 filed Mar. 18, 1999 and now U.S. Pat. No. 6,076,458.

BACKGROUND OF THE INVENTION

DETAILED DESCRIPTION OF THE INVENTION

1. Field of the Invention

The present invention relates to a stencil printing apparatus that allows normal stencil printing to be restarted at the first print sheet even after a long rest.

2. Prior Art

A stencil printing apparatus prints out a desired image on a print sheet by winding a stencil sheet perforated in a stencil making section on a printing drum and pinching the print paper fed from a sheet supply section between a roller and the printing drum.

Such a stencil printing apparatus, when left for a long time with no operation, often causes the ink existing on inner and outer surfaces of the drum including the openings, etc., as well as between the drum and a stencil sheet, etc. to dry.

Consequently, when a stencil making and printing operation is restarted after a long rest, it is difficult to supply a proper amount of ink onto the inner and outer surfaces of the drum and to between the drum and a stencil sheet. It is thus hardly possible to secure a normal print density at the first print sheet. The print image will thus be apt to become faint, and accordingly, quite a lot of print sheets are usually wasted until a desired print quality is obtained. This has arisen problems such as an increase in the printing cost, requirement of a long printing time, etc. The major factors of those problems are items (1) and (2) described below.

(1) The ink existing in the printing drum section, as well as between the printing drum section and a stencil sheet dries while the apparatus is at rest and a proper amount of ink for normal printing cannot be secured.

(2) The used stencil sheet for printing must be removed from the printing drum and discharged before a newly perforated stencil sheet is wound on the printing drum. The used stencil sheet often bears considerably much ink even when it is discharged.

The viscosity of the ink used for stencil printing depends significantly on the ambient temperature, as well as on how long the apparatus is left at rest. Consequently, even when the ink is kept under a low temperature for a long time, a faint image problem often occurs.

SUMMARY OF THE INVENTION

Under such the circumstances, it is an object of the present invention to provide a stencil printing apparatus that assures normal stencil printing to be restarted at the first print sheet even after a long rest.

The stencil printing apparatus in the first embodiment of the present invention comprises a stencil making means for perforating each stencil sheet with a desired image pattern; a porous structure printing drum incorporating an ink supply mechanism to be wound with the stencil sheet perforated by the stencil making means; a sheet supply means for supplying print sheets; a roller for pinching the print sheet supplied from the sheet supply means between the printing drum and itself; and time counting means for counting the rest time of the stencil printing apparatus. In addition, the stencil printing apparatus further comprises controlling means for controlling before the apparatus is started up so that a non-perforated stencil sheet is wound on the printing drum, supply of print sheets from the sheet supply means is inhibited, and the printing drum is rotated, thereby the pinching time between the printing drum and the roller is changed according to the time data counted by the time counting means.

The stencil printing apparatus in the second embodiment of the present invention comprises a stencil making means for perforating each stencil sheet with a desired image pattern; a porous structure printing drum incorporating an ink supply mechanism to be wound with the stencil sheet perforated by the stencil making means; a roller for pinching the print sheet supplied from the sheet supply means between the printing drum and itself; and temperature detecting means for detecting the temperature in the printing drum. In addition, the stencil printing apparatus further comprises controlling means for controlling before the apparatus is started up so that a non-perforated stencil sheet is wound on the printing drum and the printing drum is rotated while supply of print sheets from the sheet supply means is inhibited, thereby the pinching time between the printing drum and the roller is changed according to the temperature data detected by the temperature detecting means.

The stencil printing apparatus in the third embodiment of the present invention comprises a stencil making means for perforating each stencil sheet with a desired image pattern; a porous structure printing drum incorporating an ink supply mechanism to be wound with the stencil sheet perforated by the stencil making means; a sheet supply means for supplying print sheets; a roller for pinching the print sheet supplied from the sheet supply means between the printing drum and itself; time counting means for counting the no-operation time of the stencil printing apparatus; and temperature detecting means for detecting the temperature in the printing drum. In addition, the stencil printing apparatus further comprises controlling means for controlling before the apparatus is started up so that a non-perforated stencil sheet is wound on the printing drum, supply of print sheets from the sheet supply means is inhibited, and the printing drum is rotated, thereby the pinching time between the printing drum and the roller is changed according to the time data counted by the time counting means and the temperature information detected by the temperature detecting means.

The stencil printing apparatus in the fourth embodiment of the present invention comprises a stencil making means for perforating each stencil sheet with a desired image pattern; a porous structure printing drum incorporating an ink supply mechanism to be wound with the stencil sheet perforated by the stencil making means; a sheet supply means for supplying print sheets; a roller for pinching the print sheet supplied from the sheet supply means between the printing drum and itself; time counting means for counting the no-operation time of the stencil printing apparatus; and storing means for storing data corresponding to the time of the pinching frequency between the printing drum and the roller. In addition, the stencil printing apparatus further comprises controlling means for controlling so that a non-perforated stencil sheet is wound on the printing drum, supply of print sheets from the sheet supply means is inhibited, the printing drum on which the non-perforated stencil sheet is wound is rotated, and the pinching frequency data is read from the storing means according to the time counted by the time counting means, thereby the pinching between the printing drum and the roller is changed according to this read pinching frequency before a stencil making operation is performed by the stencil printing apparatus.

The stencil printing apparatus in the fifth embodiment of the present invention comprises a stencil making means for perforating each stencil sheet with a desired image pattern; a porous structure printing drum incorporating an ink supply mechanism to be wound with the stencil sheet perforated by the stencil making means; a sheet supply means for supplying print sheets; a roller for pinching the print sheet supplied from the sheet supply means between the printing drum and itself; temperature detecting means for detecting the temperature in the printing drum; and storing means for storing data corresponding to the temperature of the pinching frequency between the printing drum and the roller. In addition, the stencil printing apparatus further comprises controlling means for controlling so that a non-perforated stencil sheet is wound on the printing drum, supply of print sheets from the sheet supply means is inhibited, the printing drum on which the non-perforated stencil sheet is wound is rotated, and the pinching frequency data is read from the storing means according to the temperature detected by the temperature detecting means, thereby the pinching between the printing drum and the roller is controlled according to this read pinching frequency before a stencil making operation is performed by the stencil printing apparatus.

The stencil printing apparatus in the sixth embodiment of the present invention comprises a stencil making means for perforating each stencil sheet with a desired image pattern; a porous structure printing drum incorporating an ink supply mechanism to be wound with the stencil sheet perforated by the stencil making means; a sheet supply means for supplying print sheets; a roller for pinching the print sheet supplied from the sheet supply means between the printing drum and itself; time counting means for counting the rest time of the stencil printing apparatus; temperature detecting means for detecting the temperature in the printing drum; and storing means for storing data corresponding to the time and the temperature of the pinching frequency between the printing drum and the roller. In addition, the stencil printing apparatus further comprises controlling means for controlling so that a non-perforated stencil sheet is wound on the printing drum, supply of print sheets from the sheet supply means is inhibited, the printing drum on which the non-perforated stencil sheet is wound is rotated, and the pinching frequency data is read from the storing means according to the time detected by the time counting means and the temperature detected by the temperature detecting means, thereby the pinching between the printing drum and the roller is controlled according to this read pinching frequency before a stencil making operation is performed by the stencil printing apparatus.

As described above in detail, according to the present invention, an auto idling operation is performed with a pinching time decided according to the rest time of the stencil printing apparatus, the temperature in the printing drum, and the temperature of the ink in the printing drum. It is thus possible to improve the viscosity of the ink in the drum, as well as supply a proper amount of the ink for assuring a normal print density on the inner and outer surfaces of the drum, as well as to between the drum and a stencil sheet. Consequently, it is possible to reduce occurrence of imperfect prints such as thin images that are often seen in the conventional art.

Furthermore, such an optimized auto idling operation is possible at any temperature if the operation temperature of the apparatus is within the tolerance. Consequently, perfect stencil printing can be restarted at the first print sheet. In addition, since such an auto idling operation is assured with the optimized press count, redundant idling operations can be avoided.

BRIEF DESCRIPTION OF THE DRAWINGS

FIG. 12 illustrates the correspondence between the press count data and the rest time data x, indicated in a table format.

FIG. 13 illustrates the correspondence between the press count data and the temperature data y, indicated in a table format.

FIG. 14 illustrates the correspondence between the press count data and a combination of the rest time data x and the temperature data y, indicated in a table format.

DETAILED DESCRIPTION OF THE PREFERRED EMBODIMENTS

Figure 1:
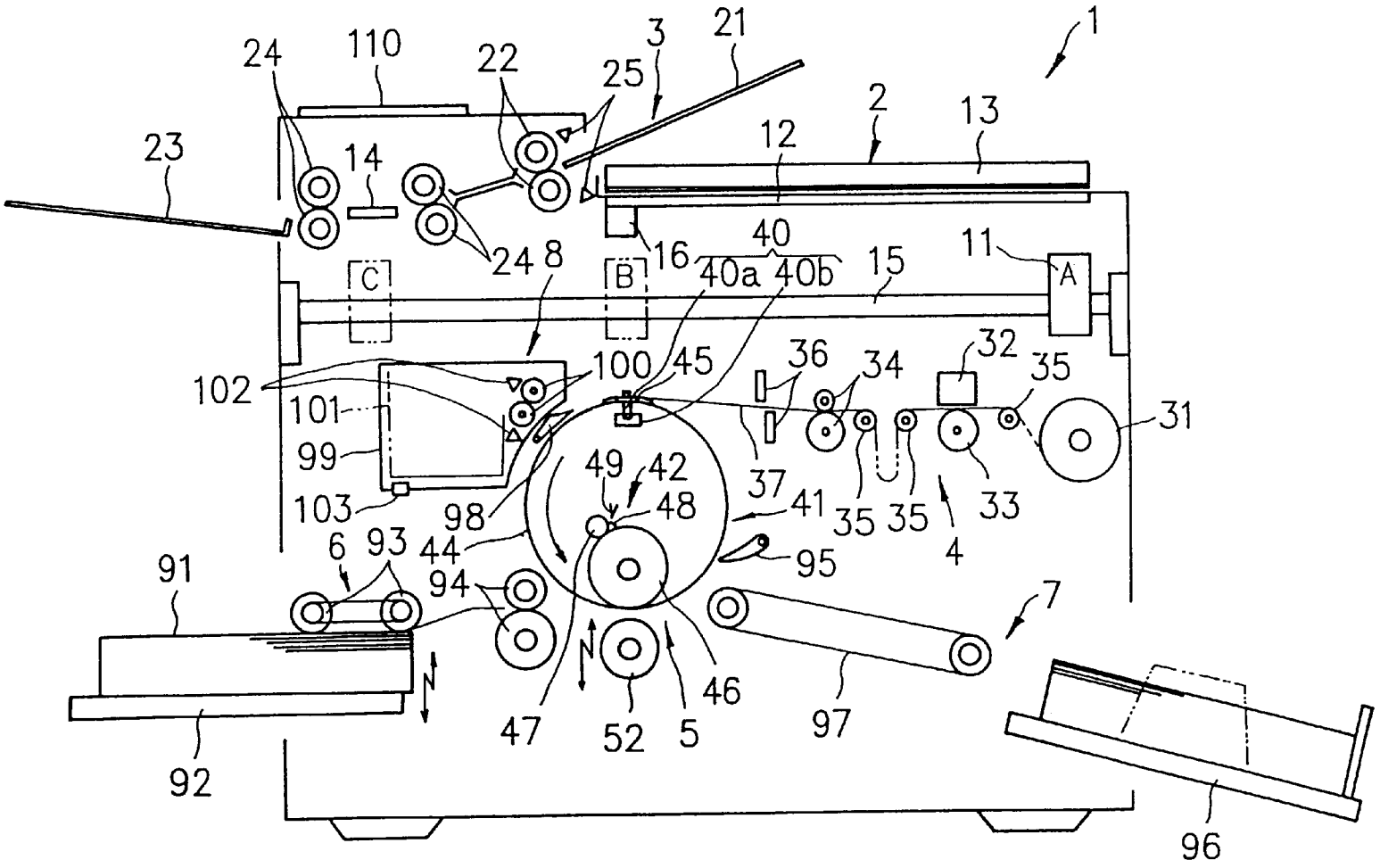
FIG. 1 is a schematic diagram showing a whole constitution of a stencil printing apparatus of the present invention.
Figure 2:
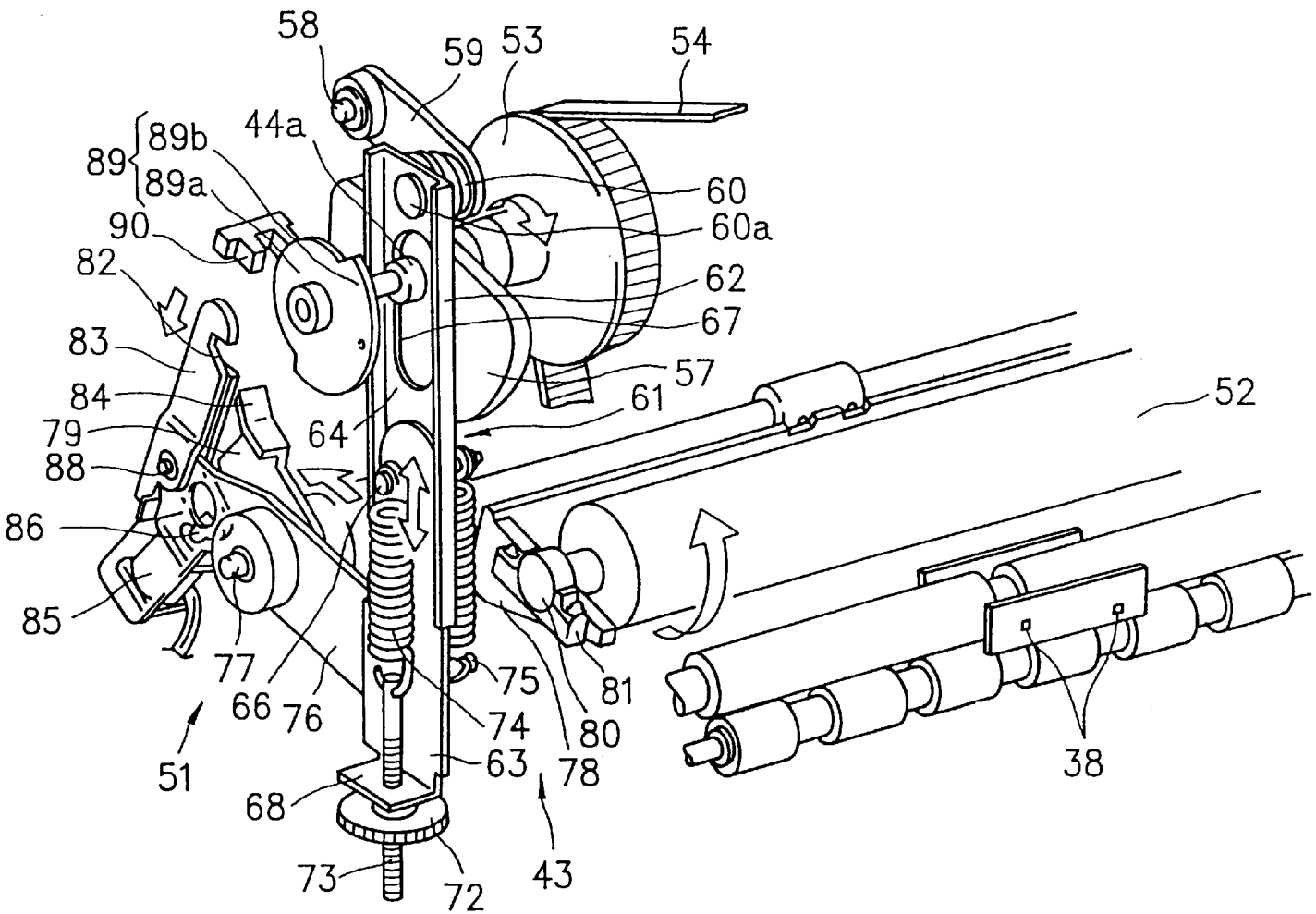
FIG. 2 is a perspective view of a driving mechanism of a press-roller section in the stencil printing apparatus illustrated in FIG. 1.
Figure 3:
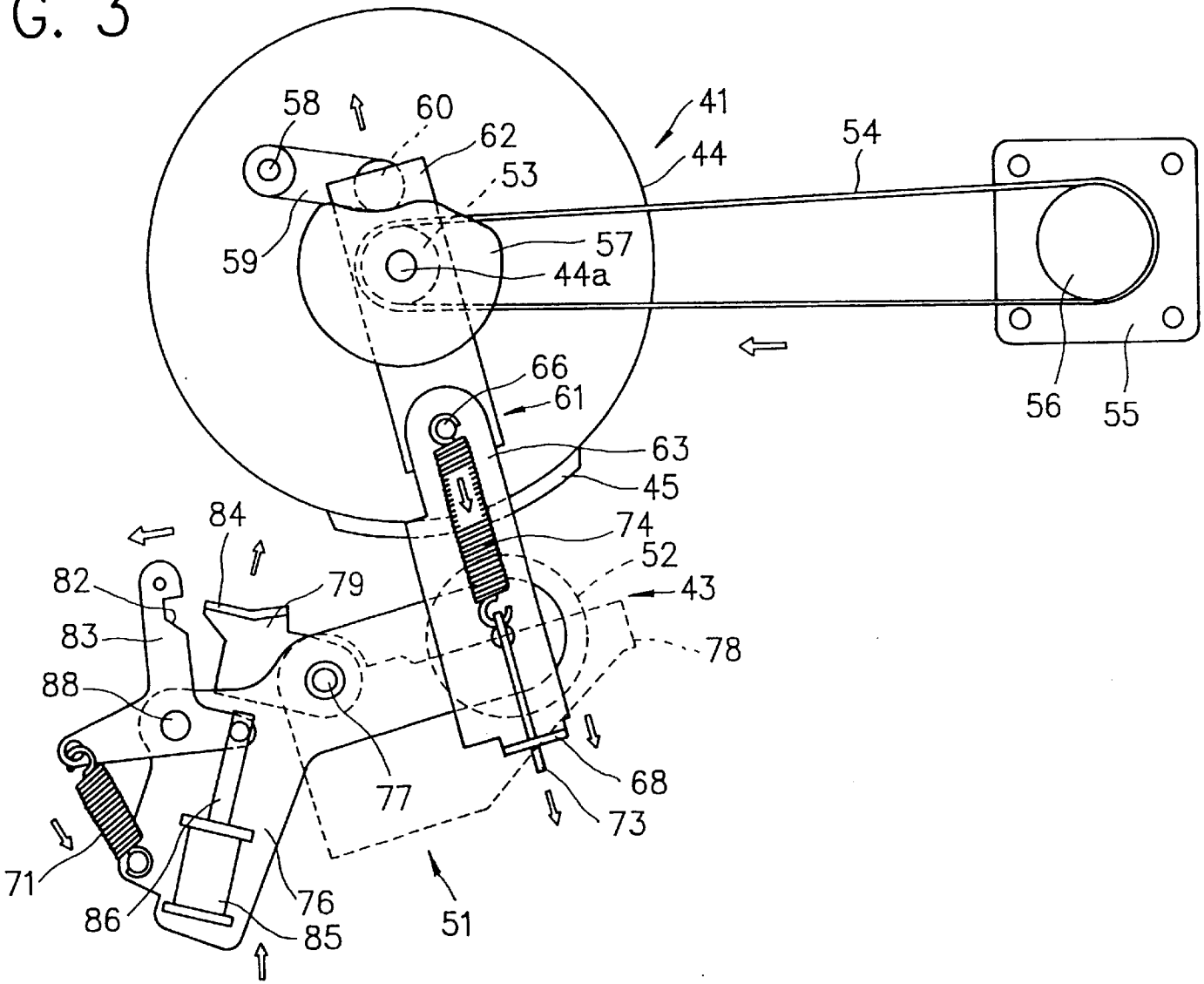
FIG. 3 is a side view of the press-roller illustrated in FIG. 2, which is released from the printing drum.
Figure 4:
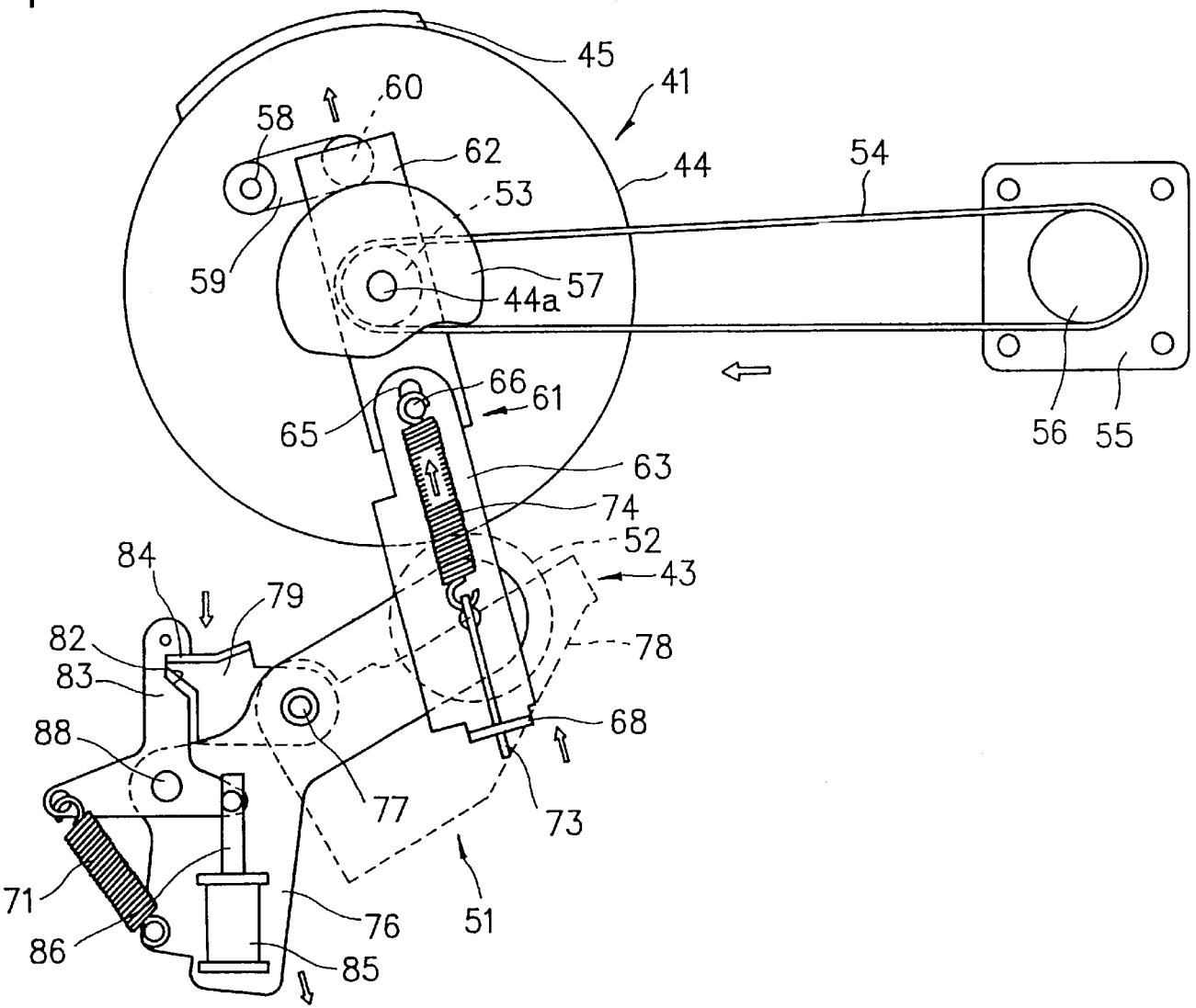
FIG. 4 is a side view of the press-roller illustrated in FIG. 2, which is pressed against the outer surface of the printing drum.

FIG. 1 illustrates a schematic diagram showing a whole constitution of the stencil printing apparatus of the present invention. FIG. 2 is a perspective view of a driving mechanism of a press-roller in the stencil printing apparatus. FIG. 3 is a side view of the press-roller illustrated in FIG. 2, which is released from a printing drum. FIG. 4 is a side view of the press-roller illustrated in FIG. 2, which is pressed against the outer surface of the printing drum.

Hereunder, the whole configuration of the stencil printing apparatus will be described at first.

As illustrated in FIG. 1, the stencil printing apparatus 1 comprises mainly a document reading section 2, an auto document feeder (hereafter, to be referred to as ADF) 3, a stencil making section 4, a printing section 5, a sheet supply section 6, a sheet discharge section 7, and a stencil sheet discharge section 8.

The document reading section 2 comprises a line image sensor 11, a document glass pad 12, a press plate 13, and a target glass plate 14. The line image sensor 11 is held by a guide rail 15. Guided by this guide rail 15, the line image sensor 11 is moved horizontally (in the right-left direction in FIG. 1) by a driving device (not illustrated). On the document glass pad 12 is placed a document sheet, from which a printing plate for picture papers, books, etc. is formed. The press plate 13 is disposed on the document glass pad 12 so as to be opened and closed freely. Document sheets are supplied one by one to the target glass plate 14 by the ADF 3.

The line image sensor 11, when a document sheet is to be read, scans and moves the sheet at a predetermined speed between the home position shown with A and the scanning end shown with B in FIG. 1 under the document glass pad 12. The line image sensor 11, when a document sheet is read using the ADF 3, is disposed fixedly at a place shown with C in FIG. 1, right under the target glass plate 14.

The document reading section 2 is also provided with a press plate side document sensor 16 used to detect a document sheet set on the document glass pad 12.

The ADF 3 comprises a document tray 21, a document pick-up roller 22, a document ejection tray 23, and document feed rollers 24. On the document tray 21 are stacked a plurality of document sheets. The document pick-rollers 22 feed document sheets stacked on the document tray 21 one by one onto the target glass plate 14. The document ejection tray 23 receives document sheets after they are read. The document feed rollers 24 are disposed at both sides of the target glass plate 14. The document feed rollers 24 feed and scan document sheets on the target glass plate 14 at a predetermined speed, then delivers the document sheets onto the document ejection tray 23 from the target glass plate 14.

The ADF 3 is also provided with an optical system ADF document sensor 25 used to detect each document sheet set on the document tray 21.

In the ADF 3, document sheets set on the document tray 21 are picked up one by one by the document pick-up rollers 22 and fed by the document feed rollers 24 onto the target glass plate 14. When passing on the target glass plate 14, the line image sensor 11 positioned just under the target glass plate 14 reads the image of each document sheet. When this read operation ends, the document sheet is delivered by the document feed rollers 24 onto the document ejection tray 23.

The stencil making section 4 comprises a stencil sheet roll 31, a thermal printing head 32, a platen roller 33 disposed so as to face the thermal printing head 32, stencil sheet feed rollers 34, stencil sheet guide rollers 35, and a pair of stencil sheet cutters 36. The stencil sheet roll 31 comprises a continuous stencil sheet 37 consisting of only a thermoplastic film or a laminated sheet of a thermoplastic film and a porous supporting element. The thermal printing head 32 consists of a plurality of dot-like heating elements disposed in a horizontal line.

When the stencil making section 4 receives information of a document image read by the line image sensor 11, each of the dot-like heating elements of the thermal printing head 32 is heated selectively according to the entered image information. Consequently, the stencil sheet 37 is perforated by heat in a dot matrix format. Then, the stencil sheet cutter 36 cuts the stencil sheet 37 at a predetermined length.

The printing section 5 comprises a drum 41, an ink supply mechanism 42, and a press roller section 43. The drum 41 supported by drum supporters (not illustrated) is provided with a printing drum 44 driven rotationally counter-clockwise around itself in FIG. 1. On the printing drum 44 is wound a stencil sheet 37 clamped at one end by the stencil sheet clamping device 45 provided on the outer surface of the printing drum 44. The printing drum 44 has a porous structure that can transmit ink.

A clamping position sensor 40 is provided on the drum 41 and on the drum supporting device (not illustrated) respectively. The sensor 40 is used to detect a clamping position at which a perforated stencil sheet 37 can be clamped at the stencil sheet clamping device 45. The clamping position sensor 40 is composed of a light shielding plate **40*a* provided on the drum 41 and an optical sensor 40*b* consisting of a photodiode, etc. whose light is blocked by the light shielding plate 40*a* rotating according to the rotation of the drum 41**.

The ink supply mechanism 42 provided in the printing drum 44, being in contact with the inner surface of the printing drum 44, is composed of a squeezing roller 46 rotated together with the printing drum 44, a doctor rod 47 disposed at a predetermined distance from the outer surface of the squeezing roller 46, and an ink tank 48.

When the printing drum 44 is rotated counter-clockwise in FIG. 1, the squeezing roller 46 is also rotated synchronously with the printing drum 44 in the same direction. Consequently, the ink from the ink tank 48 is supplied onto the inner surface of the printing drum 44 via the outer surface of the squeezing roller 46.

The drum 41 is provided with a temperature sensor 49 used as the temperature detecting means. The temperature sensor 49 detects the temperature in the printing drum 44 or the temperature of the ink in the printing drum 44 directly or indirectly. The temperature sensor is composed of, for example, a thermistor, etc.

The press roller section 43 comprises a press roller 52 disposed under the printing drum 44 and to be pressed selectively by the driving mechanism 51 illustrated in FIGS. 2 through 4 to the outer surface of the printing drum 44.

As illustrated in FIGS. 2 through 4, the printing drum 44 is drivingly connected to the sprocket 53 provided on the center shaft **44*a*. The sprocket 53 is drivingly connected by an endless belt 54 to a drive sprocket 56 of a main motor 55, which functions as rotating and driving means. Consequently, the printing drum 44 is driven rotationally by the main motor 55 clockwise in FIGS. 3 and 4** intermittently or continuously.

On the center shaft **44*a* of the printing drum 44 is attached an eccentric cam 57 positioned outside the sprocket 53. The eccentric cam 57 has threads and roots. The cam 57 is rotated unitarily with the printing drum 44. A cam follower lever 59 is engaged with the eccentric cam 57. One end of the cam follower lever 59 is supported by a shaft 58 on a machine frame (not illustrated). The cam follower lever 59 is pressed down in FIG. 2 by a spring (not illustrated) and the other end is drivingly connected to a link member 61 by a shaft 60*a* of a bearing 60**.

The link member 61 consists of two plate-like members (upper link 62 and lower link 63). The upper link member 62 is directly connected to the cam follower lever 59 by the shaft **60*a* of the bearing 60. The upper link member 62 is provided with a left-open sliding groove in which the lower link member 63** slides.

The link member 61 can be extended/shrunk in the length direction when the lower link member 63 is guided and moved in the groove 64 of the upper link member 62. A long hole is formed in the lower link member 63 and a pin 66 fixed to the upper link member 62 is fit in this long hole 65. Consequently, the link member 61 is restricted in its maximum extension and shrinkage.

A long hole 67 is formed in the upper link member 62. The long hole 67 is used to escape the center shaft **44*a* of the printing drum 44. Consequently, according to the rotation of the eccentric press cam 57, the whole link member 61** is moved up/down.

The lower end part of the lower link 63 is bent like an L-letter to form a supporting plate section 68. The supporting plate section 68 is provided with a pulse motor used as driving means for deceleration, as well as a decelerating mechanism for decelerating the output of the pulse motor. The gear attached to the output shaft of the pulse motor is engaged with a large diameter gear 72 composing the decelerating mechanism together with this gear.

In the supporting plate section 68 of the lower link member 63 is screwed a threaded control rod 73 through the center of the large diameter gear 72. A tensile coil spring 74 is provided between one end of the control rod 73 and the engaged pin 66 of the upper link member 62. Consequently, the lower link member 63 is pulled up in FIG. 2 with respect to the upper link member 62.

As illustrated in FIG. 2, one end of a rocking lever 76 is connected to the lower link member 63 by a shaft 75. A middle part of the rocking lever 76 is supported rotationally by a shaft 77 from the machine frame (not illustrated). A connecting plate 78 and one end of a connecting lever 79 are connected fixedly to a shaft 77 of the rocking lever 76 on the same shaft. On the connecting plate 78 is attached a bracket 81 supporting the press roller 52 rotationally via a rotary shaft 80. To the other end of the rocking lever 76 is attached a hook lever 83 at the tip of which a key groove 82 is formed. At the end part of the connecting lever 79 is provided an engaging member 84 which allows the hook lever 83 to fit in the key groove 82. Consequently, the rocking lever 76 is drivingly connected to the connecting lever 79 when the rocking lever 76 is rotated counter-clockwise in FIG. 2.

A tensile coil spring 71 is attached between the hook lever 83 and the rocking lever 76. Consequently, the hook lever 83 is enforced to rotate counter-clockwise in FIGS. 3 and 4 with respect the rocking lever 76, that is, in the direction in which the hook lever is released from the rocking lever 76 (the status illustrated in FIG. 3).

A press solenoid 85 is provided on the rocking lever 76. The drive shaft 86 of the press solenoid 85 is connected to the hook lever 83 held rotationally to the rocking lever 76 by the rotary shaft 88. The hook lever 83 is driven rotationally and selectively clockwise in FIGS. 3 and 4 by the press solenoid 85. If the press solenoid 85 is turned on, the key groove 82 of the hook lever 83 is fit in the fitting part 84 of the connecting lever 79 and the rocking lever 76 is drivingly connected to the connecting lever 79 (as illustrated in FIG. 4).

As illustrated in FIG. 2, a detecting disk 89 is attached to the tip of the center shaft 44*a* of the printing drum 44. The detecting disk 89 is used to obtain a timing signal for turning off the press solenoid. The detecting disk 89 comprises a small diameter member 89*a* and a large diameter member 89*b* shifted by 180 degrees from the member 89*a*. On the rotary trail of the large diameter member 89*b* of the detecting disk 89 is provided a press sensor 90 consisting of a photo-interrupter, etc. The light from the sensor 90 is blocked by the large diameter member 89*b* when the press roller is pressed against the outer surface of the printing drum 44. The detecting disk 89 is attached to the center shaft 44*a* of the printing drum 44 so that the light from the press sensor 90 is blocked by the large diameter member 89*b* when a page sensor 38 detects a print sheet 91.

Figure 5:
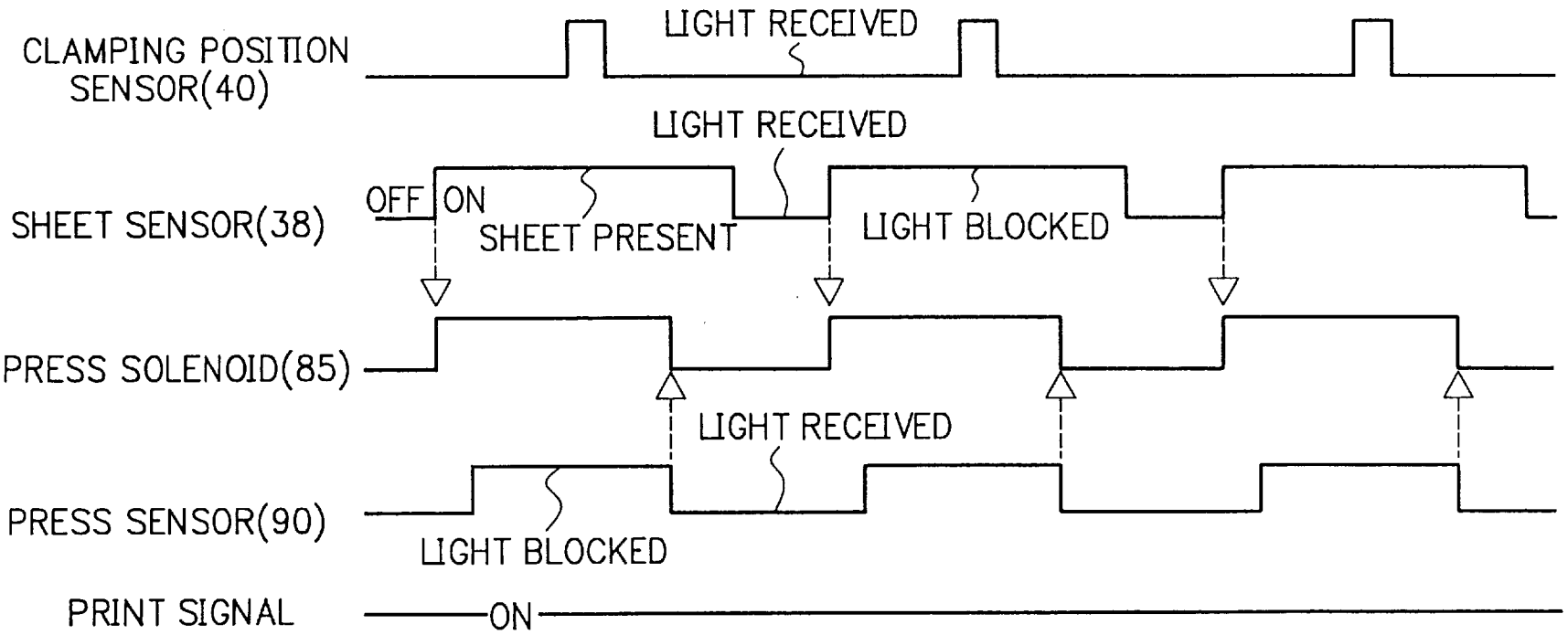
FIG. 5 is a timing chart of the operation of a press solenoid during a printing operation.

FIG. 5 illustrates an operation timing chart of the press solenoid during a printing operation.

In FIG. 5, a print signal is used to feed the print sheet 91 from the sheet supply section 6 to between the printing drum 44 and the press roller 52. When this print signal is turned on, the light axis of a paper sensor 38 (to be described later) is blocked. In other words, when the print sheet 91 is detected, the press solenoid 85 is turned on. When the light axis of the press sensor 90 is not blocked, that is, when a print sheet 91 is printed, the press solenoid 85 is turned off.

If the eccentric press cam 57 is positioned as illustrated in FIGS. 2 and 3 in the driving mechanism, the entire link member 61 is positioned low. And, the press roller 52 is released from the printing drum 44 as illustrated in FIGS. 2 and 3.

When the center shaft 44*a* of the printing drum 44 driven by the main motor 55 is rotated by 180 degrees clockwise in FIG. 3 from the position illustrated in FIGS. 2 and 3, the eccentric press cam 57 is also rotated by 180 degrees. Then, the entire link member 61 goes up and the rocking lever 76 is rotated counter-clockwise around the shaft 77 of the rocking lever 76.

At this time, the press solenoid 85 is turned on and pulled. When the fitting part 84 of the connecting lever 79 is fit in the key groove 82 of the hook lever 83, the rotation of the rocking lever 76 is transmitted to the connecting lever 79 via the hook lever 83. Consequently, the connecting lever 79 is rotated counter-clockwise in FIG. 3 around the shaft 77 and moved in the direction where the press roller 52 is pressed against to the outer surface of the printing drum 44, that is, moved to the press working position (status in FIG. 4). Consequently, the supplied print sheet 91 is pressed against the outer surface of the printing drum 44, thereby to perform the press type stencil printing.

When the center shaft 44*a* of the printing drum 44 driven by the main motor 55 is further rotated by 180 degrees clockwise, the center shaft 44*a* returns to the status illustrated in FIGS. 2 and 3. Then, synchronously with the printing drum in rotation, the press roller 52 is pressed against and released from the printing drum 44 repetitively.

As illustrated in FIG. 1, the sheet supply section 6 comprises a sheet supply pad 92, a sheet supply roller 93, and a timing roller 94. On the sheet supply pad 92 are stacked a fan-folded print paper 91. The sheet supply roller 93 takes out the print sheets 91 one by one starting at the top one. The timing roller 94 feeds each of the print sheets 91 to between the printing drum 44 and the press roller 52.

The timing roller 94 is provided with a paper sensor 38 used to detect the presence of a print sheet 91 fed from the sheet supply roller 93. The paper sensor 38 is composed of, for example, a light projector and a light receiver that are paired. When a print sheet 91 is fed from the timing roller 94 to the printing drum 44, the light from the light projector is blocked. On the contrary, when no print sheet 91 is fed to the timing roller 94, the light from the light projector is received by the light receiver.

When an auto idling operation (to be described later) is executed, the sheet supply section 6 is stopped, so that it is inhibited to feed any print sheet 91 to between the printing drum 44 and the press roller 52.

As illustrated in FIG. 1, the sheet discharge section 7 comprises a stripping nail 95, a sheet discharge tray 96, and a belt conveyor type sheet discharge carrier 97. The stripping nail 95 strips a printed sheet 91 from the printing drum 44. The sheet discharge tray 96 stacks printed sheets 91. The sheet discharge carrier 97 carries each printed sheet 91 stripped from the printing drum 44 by the stripping nail 95 onto the sheet discharge tray 96.

In the case of stencil sheet printing, the printing drum 44 is rotationally driven counter-clockwise in FIG. 1 by the main motor 55 around its center shaft line. The print sheet 91 is fed into between the printing drum 44 and the press roller 52 while moving from left to right at a predetermined timing synchronized with the rotation of the printing drum 44 by the timing roller 94. Consequently, the print sheet 91 is pressed against the perforated stencil sheet 37 set on the outer surface of the printing drum 44 by the press roller 52, thereby the press type stencil printing is performed on the print sheet 91.

The printed sheet 91 is stripped by the stripping nail 95 from the printing drum 44, then carried onto the sheet discharge tray 96 by the sheet discharge carrier 97. The printed sheet 91 is thus stacked on the sheet discharge tray 96 with its printed image side up.

As illustrated in FIG. 1, the stencil sheet discharge section 8 comprises a separating nail 98, a waste box supporter 99, and a waste stencil sheet discharge roller 100. The separating nail 98 separates a stencil sheet 37 wound on the outer surface of the printing drum 44. The waste box supporter 99 supports the waste stencil sheet box 101 removably. The waste stencil sheet box 101 stocks used stencil sheets 37. The discharge roller 100 feeds a stencil sheet 37 separated from the printing drum 44 by the separating nail 98 into the waste box 101.

At the inlet of the waste box 101 is provided a photoelectric waste sensor 102. The waste sensor 102 detects that a used stencil sheet 37 is fed into the waste box 101.

The used stencil sheet discharge section 8 is provided with a waste box sensor 103 used to detect that the waste box 101 is set at the waste box supporter 99.

As illustrated in FIG. 1, on top of the stencil printing apparatus is provided an operation panel 110 to be operated by the user. The operation panel 110 is provided with a ten-key pad, a PRINT START key for starting a printing operation, a STENCIL MAKING START key for starting only a stencil making operation automatically, a STENCIL MAKING/PRINTING AUTO key for starting a series of operations from stencil making to printing automatically, a STOP key for stopping an operation, etc. The operation panel 110 is also provided with a display unit such as a LCD (liquid crystal display) for displaying a set print sheet count, and various other messages.

Next, each preferred embodiment for an auto idling operation in the stencil printing apparatus will be described with reference to FIGS. 6 through 11.

An auto idling operation is performed before a printing operation is restarted after a long rest of the stencil printing apparatus 1, or after a long-term storage of ink under a low temperature. The auto idling operation is an operation for rotating the drum 41 several times with a non-perforated stencil sheet wound thereon while the press is set before the first master making operation is started. With this idling operation, pressurized ink is sealed inside the drum 41 by the non-perforated stencil sheet, the viscosity of the ink in the drum 41 is improved and a proper amount of ink for securing a normal print density is held on the inner and outer surfaces of the drum 41, as well as between the drum 41 and the stencil sheet 37, preventing occurrence of imperfect prints.

Figure 6:
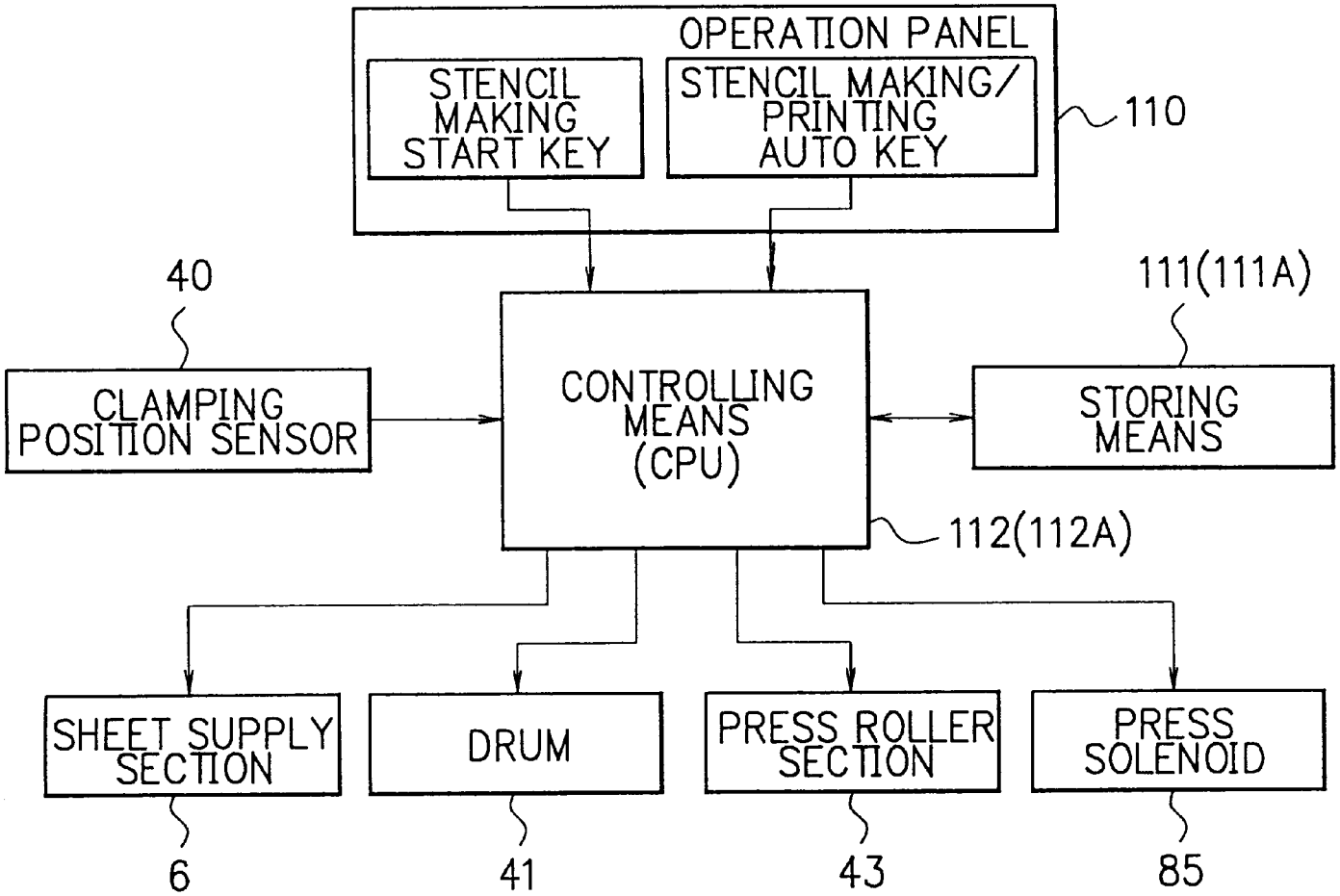
FIG. 6 is an electrical block diagram for the stencil printing apparatus illustrated in FIG. 1, which is in the first embodiment for an auto idling operation.

As illustrated in FIG. 6, in the first embodiment for the auto idling operation, the stencil printing apparatus is provided with the sheet supply section 6, the drum 41, the press roller section 43, the press solenoid 85, the operation panel 110, the clamping position sensor 40, the storing means 111A, and the controlling means 112A.

The storing means 111A is composed of, for example, a non-volatile memory such as a ROM, etc. The storing means stores the correspondence between the press count data and the rest time data x in a table format as illustrated in FIG. 12.

The controlling means 112A is composed of time counting means, comparing and discriminating means, and press count deciding means. The time counting means is restarted each time the press solenoid 85 is turned on. The time counting means is composed of an internal timer for counting the rest time of the stencil printing apparatus, that is, the rest time between the last printing operation and the next printing operation.

The comparing and discriminating means compares the time data counted by the time counting means with a preset time data (6 hours in this embodiment) thereby to discriminating between large and small.

The press count deciding means reads the press count data from the storing means 111A according to the result of comparison/discrimination of the comparing and discriminating means and decides the read press count data as a press count N of the press roller 52 for auto idling.

In not only this embodiment, but also in other embodiments, the storing means 111 stores a control program for a series of processings and the auto idling operation for stencil making operation or stencil making and printing operation. And the controlling means 112 in each embodiment controls the operation of the stencil printing apparatus 1 using the control program stored in the storing means 111 according to each command from the operation panel 110.

Figure 7:
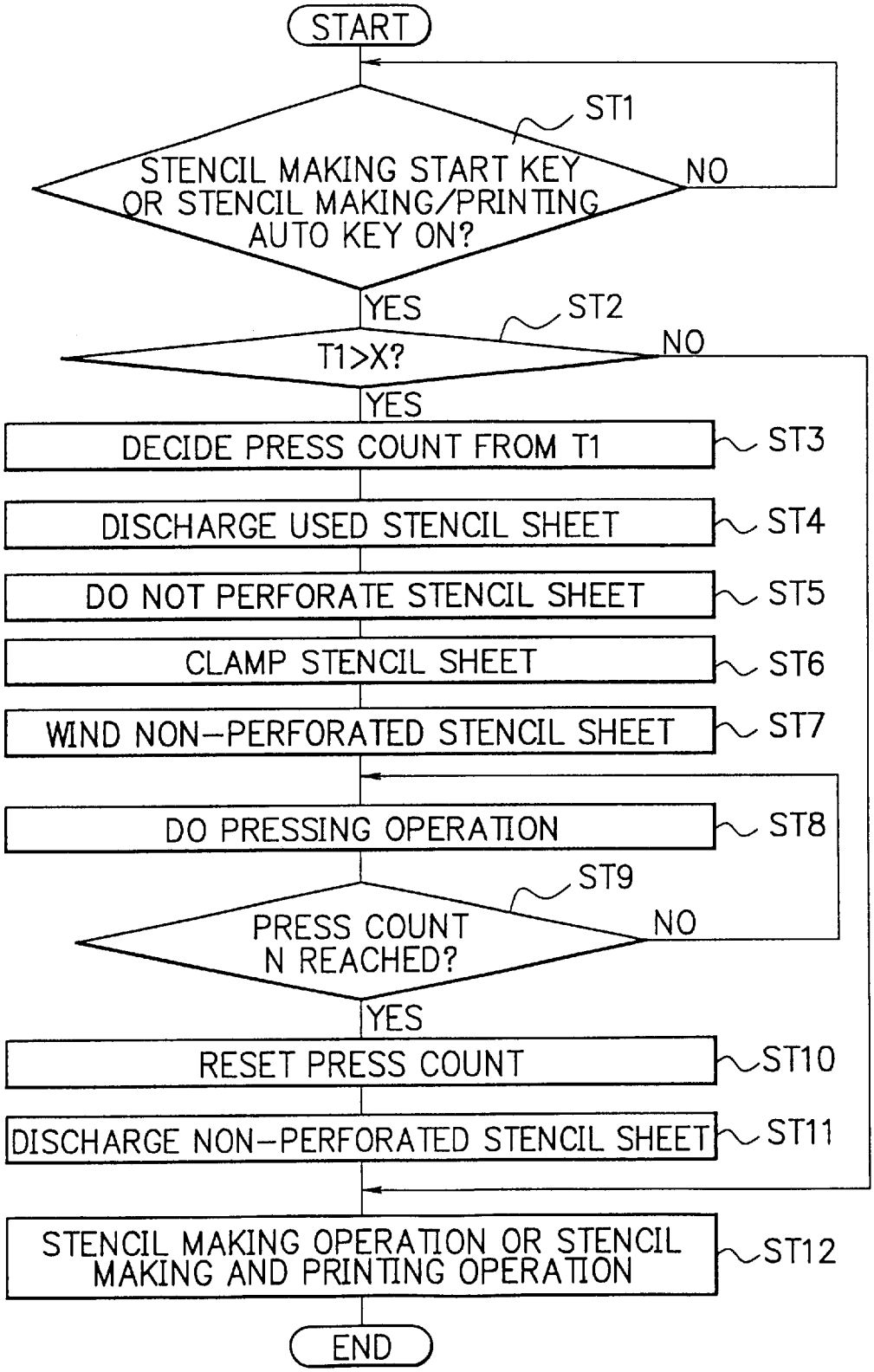
FIG. 7 is a flow chart of the auto idling operation in the first embodiment.

Next, the auto idling operation in the first embodiment will be described with reference to the flow chart illustrated in FIG. 7.

If the stencil printing apparatus 1 is rested after a stencil making operation or stencil making and printing operation, the press solenoid 85 is switched from ON to OFF and kept in this status. The time counting means restarts counting at this last count value when the press solenoid 85 is turned on again.

After this, if either the STENCIL MAKING START key. or the STENCIL MAKING/PRINTING AUTO key is turned on (ST1-YES) for a stencil making operation or stencil making and printing operation, the time count data of the time counting means is compared with the rest time data stored in the storing means 111A. If time count T1>rest time x is satisfied, that is, if T1 is 6 hours or over (ST2-YES), the press count data corresponding to the rest time data x, which indicates the counted time data T1 is read from the storing means 111A and the read press count data is decided as the press count N of the press roller 52 (ST3). For example, if the time count data T1 is 20 hours, the value "8" of $18 \leqq x < 24$ in FIG. 12 is decided as the press count N.

Then, the stencil sheet 37 having been used so far is discharged (ST4). Concretely, the stencil sheet 37 wound on the outer surface of the printing drum 44 is removed and transferred into the waste box 101.

After this, another stencil sheet 37 is processed (ST5). Concretely, the stencil sheet 37 that is not perforated in the stencil making section 4 is carried onto the printing drum 44. The tip of the non-perforated stencil sheet 37 is clamped at the stencil sheet clamping device 45 (ST6).

Next, the non-perforated stencil sheet 37 is wound (ST7). Concretely, the non-perforated stencil sheet 37, which is still clamped at the stencil sheet clamping device 45, is wound on the outer peripheral surface of the printing drum 44 after the drum 41 is rotated counter-clockwise in FIG. 1. At this time, when the stencil sheet for one stencil master arrives at the printing drum 44, the continuous stencil sheet 37 is cut into a one-stencil master length by the stencil sheet cutter 36.

When the stencil sheet 37 arrives at the printing drum 44, no print sheet 91 is supplied yet from the sheet supply section 6; the press roller 52 just presses the printing drum 44 against the press roller 52 at this time. After this, a press processing is carried out according to the press count N decided by the press count deciding means (ST8). At this time, supply of print sheets 91 from the sheet supply section 6 is still inhibited.

When the press count N decided by the press count deciding means is reached (ST9-YES), the press roller 52 resets the press count (ST10). At this time, the press count of the press roller 52 is assumed by counting the signal from the clamping position sensor 40.

Next, the non-perforated stencil sheet 37 is discharged (ST11). Concretely, the non-perforated stencil sheet 37 wound on the outer peripheral surface of the printing drum 44 is removed and transferred into the waste box 101. After this, a stencil making operation or stencil making and printing operation is carried out according to the key operation in ST1 (ST12).

For example, if the STENCIL MAKING START key is turned on in ST1, the stencil sheet 37 is perforated with a desired image and this perforated stencil sheet 37 is wound on the printing drum 44. The stencil printing apparatus then enters in the standby status. And, when a printing count is set and the PRINT START key is turned on, the printing operation is carried according to the set printing count. If a printing count is set and the STENCIL MAKING/PRINTING AUTO key is turned on in ST1, the stencil sheet 37 is perforated with a desired image and this perforated stencil sheet 37 is wound on the printing drum 44. The printing operation is then carried out continuously until the set printing count is reached.

In the first embodiment, the press count of the press roller 52 is set according to the rest time of the stencil printing apparatus 1 such way thereby to carry out the auto idling operation.

Figure 8:
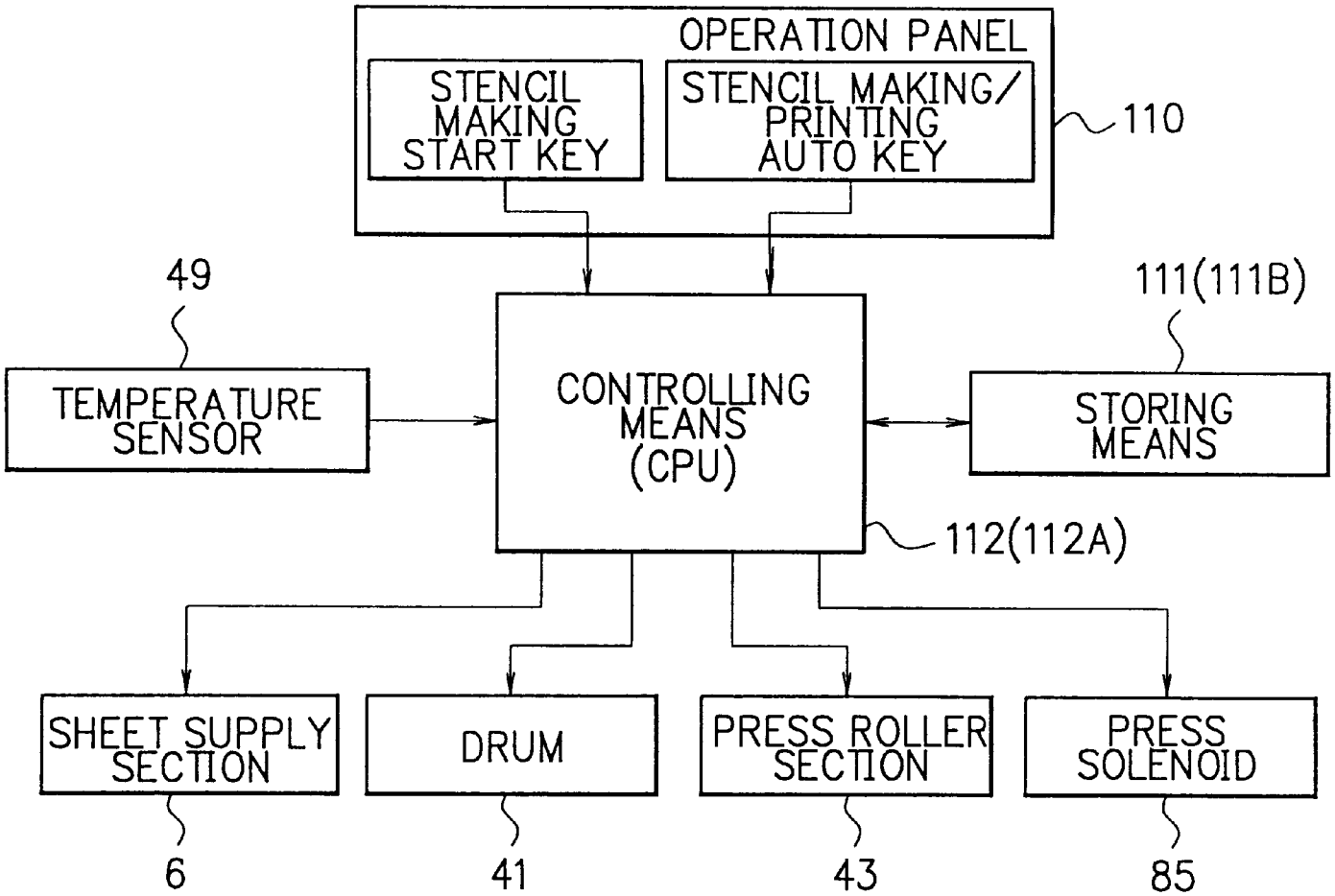
FIG. 8 is an electrical block diagram for the stencil printing apparatus illustrated in FIG. 1, which is in the second embodiment for an auto idling operation.

FIG. 8 is a block diagram of the stencil printing apparatus illustrated in FIG. 1, which is used for an auto idling operation in the second embodiment. In FIG. 8, the same numerals will be used for the same components as those in the first embodiment, avoiding redundant description.

Just like in the first embodiment, the storing means 111B in the second embodiment is composed of, for example, a non-volatile memory such as a ROM, etc. This storing means 111B stores the correspondence between the press count data and the temperature data y in a table format as illustrated in FIG. 13.

The controlling means 112B is provided with temperature discriminating means and press count deciding means. The temperature discriminating means discriminates the temperature in the printing drum 44 or the temperature of the ink in the printing drum 44 from the signal detected by the temperature sensor 49.

The press count deciding means reads the press count data from the storing means 111B according to the temperature data y discriminated by the temperature discriminating means and decides this read press count data as the press count N of the press roller 52 for an auto idling operation.

Figure 9:
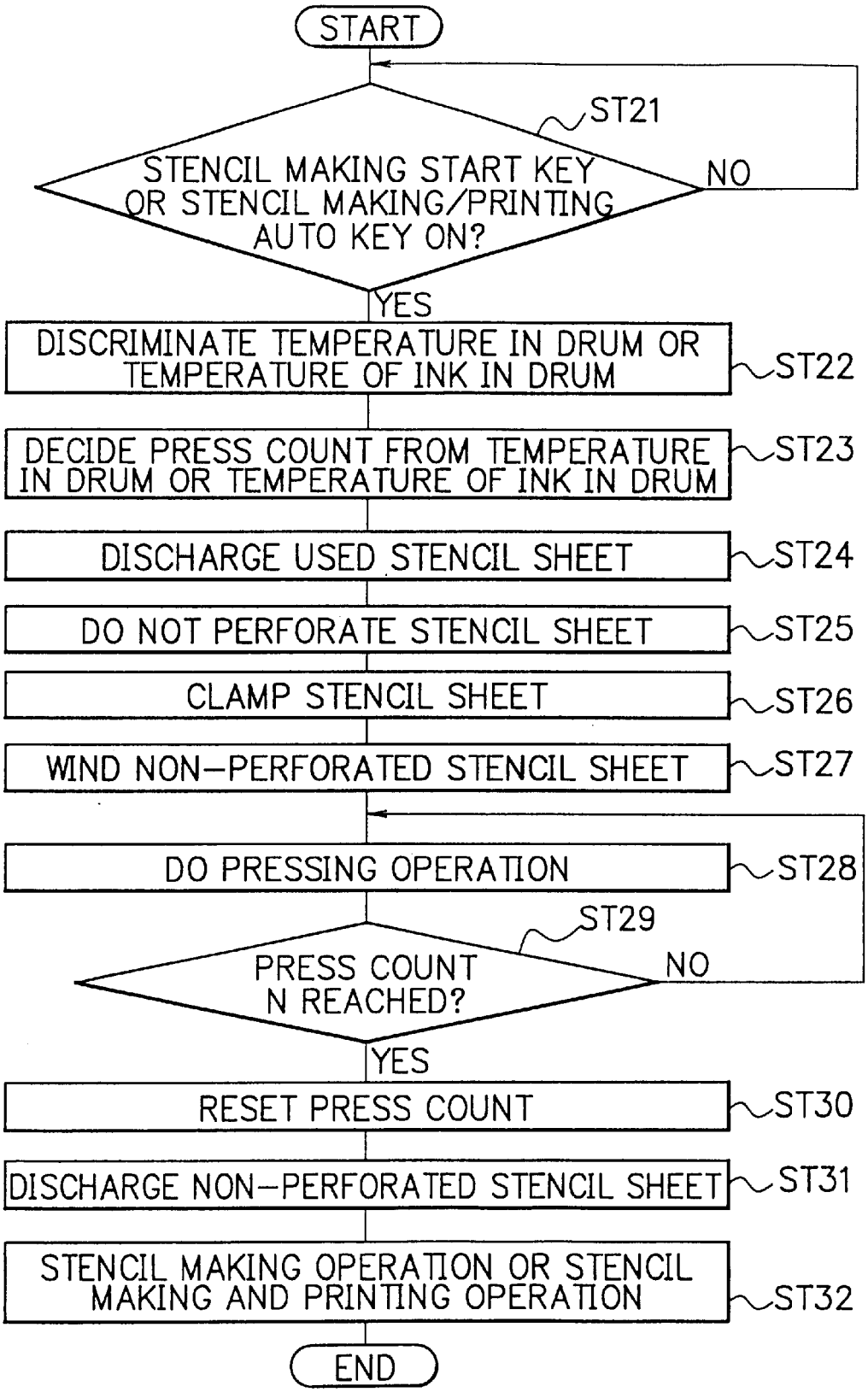
FIG. 9 is a flow chart of the auto idling operation in the second embodiment.

Next, the auto idling operation in the second embodiment will be described with reference to the flow chart in FIG. 9.

If either the STENCIL MAKING START key or the STENCIL MAKING/PRINT START key is turned on for stencil making operation or stencil making and printing operation after the stencil printing apparatus 1 is rested (ST21-YES), the temperature discriminating means of the controlling means 112B discriminates the temperature in the printing drum 44 or the temperature of the ink in the printing drum 44 from the signal detected by the temperature sensor 49 (ST22).

The press count deciding means then reads the press count data from the storing means 111B according to the temperature data y discriminated by the temperature discriminating means and decides this read press count data as the press count N of the press roller 52 (ST23). For example, if the temperature data y is 16° C., the value "7" in $15<y\leqq 20$ in FIG. 13 is decided as the press count N.

Then, the stencil sheet 37 having been used so far is discharged (ST24). Concretely, the stencil sheet 37 wound on the outer peripheral surface of the printing drum 44 is removed and carried into the waste box 101.

After this, another stencil sheet 37 is processed (ST25). Concretely, another stencil sheet 37 that is not perforated in the stencil making section 4 is carried to the printing drum 44. Then, the tip of the non-perforated stencil sheet 37 is clamped at the stencil sheet clamping device 45 (ST26).

Then, the non-perforated stencil sheet 37 is wound on the printing drum 44 (ST27). Concretely, the non-perforated stencil sheet 37, while clamped at the stencil sheet clamping device 45, is wound on the outer surface of the printing drum 44 by rotating the drum 41 counter-clockwise in FIG. 1. At this time, when the continuous stencil sheet 37 is carried on the printing drum 44, the continuous sheet 37 is cut into a one-stencil master length for one stencil master by the stencil sheet cutter 36.

When the stencil sheet 37 arrives at the printing drum 44, no print sheet 91 is supplied yet from the sheet supply section 6; the press roller 52 just presses the printing drum 44 against the press roller 52 at this time. After this, a pressing operation is carried out according to the press count N decided by the press count deciding means (ST28). At this time, supply of print sheets 91 from the sheet supply section 6 is still inhibited. When the press count N decided by the press count deciding means is reached (ST29-YES), the press roller 52 resets the press count (ST30). At this time, the press count of the press roller 52 is assumed by counting the signal from the clamping position sensor 40.

Next, the non-perforated stencil sheet 37 is discharged (ST31). Concretely, the non-perforated stencil sheet 37 wound on the outer peripheral surface of the printing drum 44 is removed and transferred into the waste box 101. After this, a stencil making operation or stencil making and printing operation is carried out according to the key operation in ST21 (ST32).

In the second embodiment, the press count of the press roller 52 is set according to the temperature in the printing drum 44 or the temperature of the ink in the printing drum 44 to perform the auto idling operation.

Figure 10:
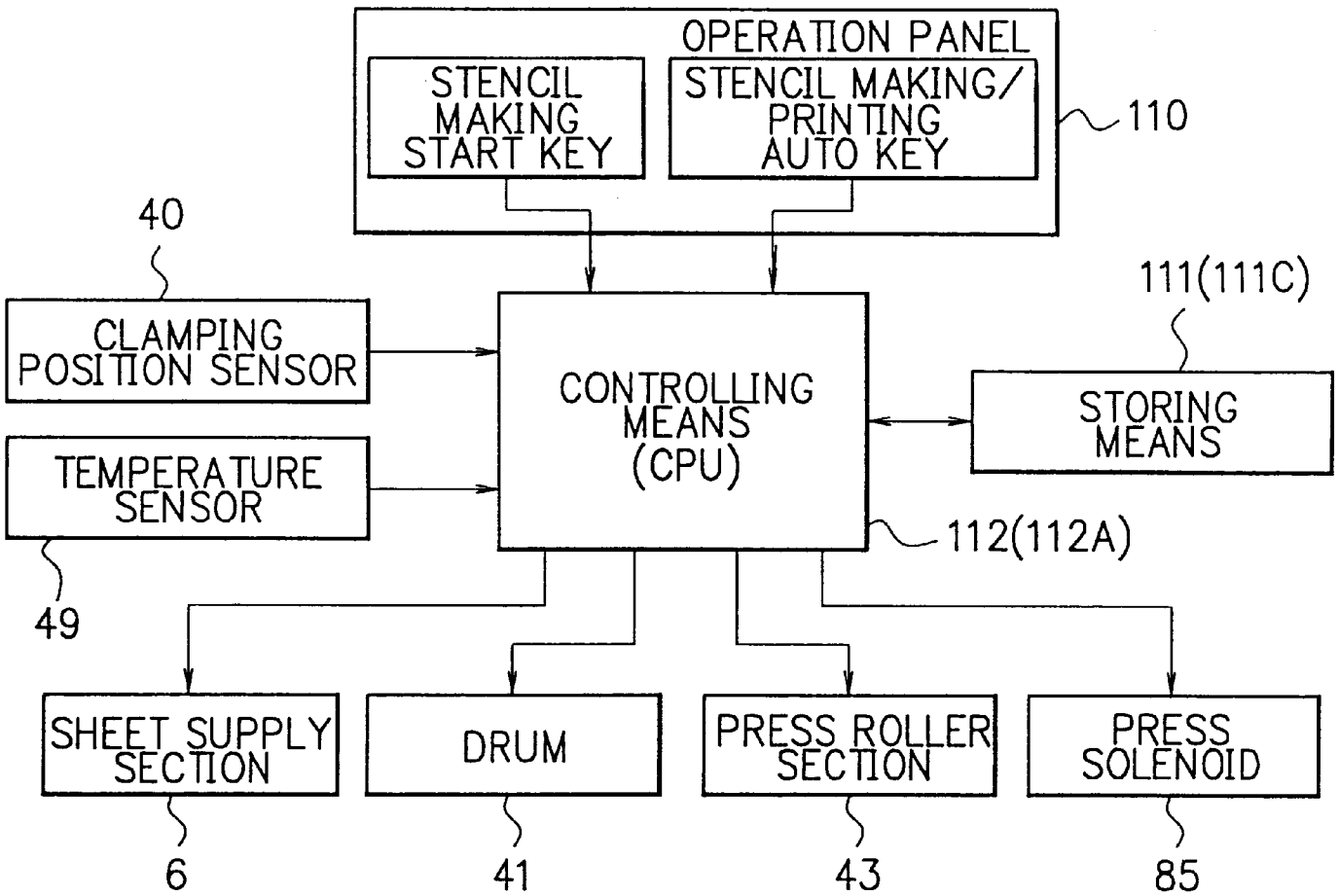
FIG. 10 is an electrical block diagram for the stencil printing apparatus illustrated in FIG. 1, which is in the third embodiment for an auto idling operation.

FIG. 10 is a block diagram of the stencil printing apparatus illustrated in FIG. 1, which is used for an auto idling operation in the third embodiment. In FIG. 8, the same numerals will be used for the same components as those in the first and second embodiment, avoiding redundant description.

Just like in the first and second embodiments, the storing means 111C in the third embodiment is composed of, for example, a non-volatile memory such as a ROM, etc. This storing means 111C stores the correspondence between the press count data and combinations of rest time data x and temperature data y in a table format as illustrated in FIG. 14.

The controlling means 112C is provided with time counting means, comparing and discriminating means, temperature discriminating means, and press count deciding means.

The press count deciding means reads press count data from the storing means 111C according to a combination of the rest time data x and the temperature data y obtained from the result of comparing and discriminating by the comparing and discriminating means and the result of discriminating by the temperature discriminating means and decides this read press count data as the press count N of the press roller 52 for an auto idling operation.

Figure 11:
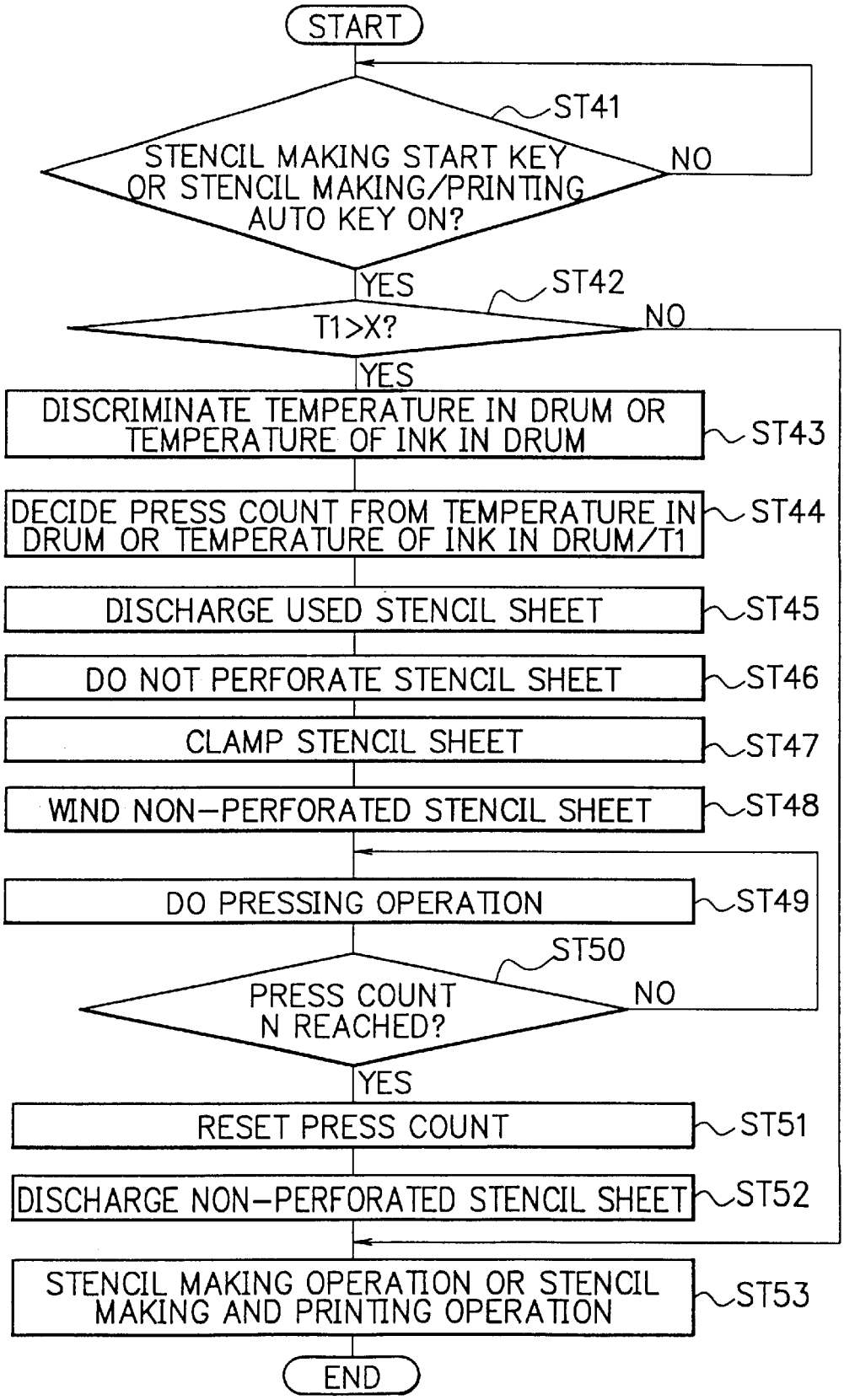
FIG. 11 is a flow chart of the auto idling operation in the third embodiment.

Next, the auto idling operation in the third embodiment will be described with reference to the flow chart in FIG. 11.

If the stencil printing apparatus 1 is rested after a stencil making operation or stencil making and printing operation, the press solenoid 85 is switched from ON to OFF and kept in this status. And, when the press solenoid 85 is turned on again, the time counting means restarts the counting at this last time count.

If either the STENCIL MAKING START key or the STENCIL MAKING OPERATION OR STENCIL MAKING AND PRINTING OPERATION START key is turned on for stencil making operation or stencil making and printing operation after a rest of the stencil printing apparatus 1 (ST41-YES), the time count data of the time counting means is compared with the rest time data stored in the storing means 111C to judge if the time count data T1 is over 6 hours or not (ST42).

In addition, the temperature discriminating means of the controlling means 112C discriminates the temperature in the printing drum 44 or the temperature of the ink in the printing drum 44 from the signal detected by the temperature sensor 49 (ST43). If the time count data T1 is judged to be over 6 hours (ST42-YES), the press count deciding means reads the press count data from the storing means 111C according to the combination of the rest time data x and the temperature data y obtained by the discriminating means and decides this read press count data as the press count N of the press roller 52 (ST44). For example, if the rest time x is 40 hours and the temperature data y is 22° C., the value "7" of the crossing position of $36 \leqq x <$ and $20 < y \leqq 25$ in FIG. 13 is decided as the press count N.

Then, the stencil sheet 37 having been used so far is discharged (ST45). Concretely, the stencil sheet 37 wound on the outer surface of the printing drum 44 is removed and carried into the waste box 101.

After this, another stencil sheet 37 is processed for non-perforation (ST46). Concretely, another stencil sheet 37 that is not perforated in the stencil making section 4 is carried to the printing drum 44. Then, the tip of the non-perforated stencil sheet 37 is clamped at the stencil sheet clamping device 45 (ST47).

The non-perforated stencil sheet 37 is then wound on the printing drum 44 (ST48). Concretely, the non-perforated stencil sheet 37, while clamped at the stencil sheet clamping device 45, is wound on the outer surface of the printing drum 44 by rotating the drum 41 counter-clockwise in FIG. 1. And, when the continuous stencil sheet 37 is carried onto the printing drum 44, the continuous sheet 37 is cut into a one-stencil master length by the stencil sheet cutter 36.

When the stencil sheet 37 arrives at the printing drum 44, no print sheet 91 is supplied yet from the sheet supply section 6; the press roller 52 just presses the printing drum 44 against itself at this time. After this, a pressing operation is carried out according to the press count N decided by the press count deciding means (ST49). At this time, supply of print sheets 91 from the sheet supply section 6 is still inhibited. When the press count N decided by the press count deciding means is reached (ST50-YES), the press roller 52 resets the press count (ST51). At this time, the press count of the press roller 52 is assumed by counting the signal from the clamping position sensor 40.

Next, the non-perforated stencil sheet 37 is discharged (ST52). Concretely, the non-perforated stencil sheet 37 wound on the outer peripheral surface of the printing drum 44 is removed and transferred into the waste box 101. After this, a stencil making operation or stencil making and printing operation is carried out according to the key operation in ST41 (ST53).

In the third embodiment, the press count of the press roller 52 is set according to the rest time of the stencil printing apparatus 1 and the temperature in the printing drum 44 or the temperature of the ink in the printing drum 44 to perform the auto idling operation.

According to each of the embodiments described above, an auto idling operation is executed according to the rest time of the stencil printing apparatus 1 and the temperature in the printing drum 44 or the temperature of the ink in the printing drum 44. With this idling operation, the viscosity of the ink in the drum 41 is improved enough and a proper amount of ink for a normal printing density is supplied onto the inner and outer surfaces of the drum 41, as well as between the drum 41 and the stencil sheet 37. Consequently, the present invention can reduce occurrence of imperfect prints such as thin images, which are often seen in the prior art.

Furthermore, an optimized auto idling operation can be executed at any temperature if the operation temperature of the stencil printing apparatus 1 is within the toleration, assuring thin image free printing to be made at the first sheet. In addition, an auto idling operation can be executed according to an optimized press count, saving redundant idling.

In each of the embodiments described above, an idling operation is carried out automatically according to the rest time of the stencil printing apparatus 1 and the temperature in the printing drum 44 or the temperature of the ink in the printing drum 44 when a printing operation is restarted after a rest of the stencil printing apparatus 1. However, a set mode key for auto idling may be provided on the operation panel 110.

In this case, when the set mode key is pressed, the controlling means 112 (112A, 112B, or 112C) executes an auto idling operation according to the rest time of the stencil printing apparatus and the temperature in the printing drum 44 or the temperature of the ink in the printing drum 44, which has been valid so far. Consequently, the user can execute a proper auto idling operation any time.

Furthermore, in each of the embodiments described above, the stencil printing apparatus is composed so that the press count of the press roller 52 can be varied according to the rest time of the stencil printing apparatus 1, the temperature in the printing drum 44 or the temperature of the ink in the printing drum 44. However, the pressing time of the press roller 52 may be varied according to the rest time of the stencil printing apparatus, the temperature in the printing drum, and the temperature of the ink in the printing drum.

Furthermore, in each of the above embodiments, the stencil printing apparatus is composed for stencil printing so that each print sheet is pressed against the printing drum by a press roller after being supplied from the sheet supply section to the porous structure printing drum incorporating an ink supply mechanism while a perforated stencil sheet is wound on the outer surface thereof. However, this composition of the apparatus may be varied freely.

For example, the present invention can apply to the stencil printing apparatuses composed as disclosed in the official gazettes of Laid-Open Japanese Patent Application No. 1-204781, No. 3-254984, and No. 7-132671. Each of the apparatuses disclosed in those gazettes is provided with a flexible printing drum, a back-press roller, and a center-press roller. The flexible printing drum has a flexible peripheral wall that can transmit ink. A stencil sheet is wound on the outer surface of this flexible peripheral wall. The back-press roller is disposed in parallel to the flexible printing drum at a predetermined interval from the flexible peripheral wall. The center-press roller is extended in the flexible printing drum so as to be in parallel to one bus line of the flexible printing drum. The center-press roller is disposed movably between a position for pressing the flexible peripheral wall outward in the radial direction so as to be bulged and deformed and a position for restoring the flexible peripheral wall to its original shape.

In the stencil printing apparatuses described above, stencil printing is performed by pinching each print sheet between the flexible printing drum and the back-press roller while the center-press roller is positioned to be bulged and deformed.

If the configuration of the apparatus in this embodiment applies to each of those stencil printing apparatuses, the bulging count of the center-press roller is controlled instead of the pressing count of the press controller, thereby the same effect as that of the above embodiment can be obtained. More concretely, before the stencil printing apparatus is started for a stencil making operation or stencil making and printing operation, a non-perforated stencil sheet is wound on the flexible printing drum. Then, while the supply of print sheets from the sheet supply section is inhibited, the flexible printing drum on which the non-perforated stencil sheet is wound is rotated. And, in this status, the center-press roller is controlled according to at least either of the rest time data or the temperature data so as to vary the time for pressing the flexible peripheral wall bulged and deformed against the back-press roller.

What is claimed is:

1. A stencil printing apparatus, comprising;

a stencil making means for perforating a stencil sheet with a desired image pattern;

a porous structure printing drum incorporating an ink supply mechanism to be wound with the stencil sheet perforated by said stencil making means;

a sheet supply means for supplying print sheets;

a roller for pinching each of said print sheets supplied from said sheet supply means between said printing drum and itself;

time counting means for counting the rest time of said stencil printing apparatus;

temperature detecting means for detecting the temperature in the printing drum; and controlling means for winding a non-perforated stencil sheet on said printing drum, inhibiting supply of said print sheets from said sheet supply means, rotating said printing drum on which said non-perforated stencil sheet is wound, and controlling the pinching time between said printing drum and said roller according to the time data counted by said time counting means and the temperature data detected by said temperature detecting means, before said stencil printing apparatus is started.

* * * * *